United States Patent [19]

Selwyn-Smith

[11] Patent Number: 4,882,864

[45] Date of Patent: Nov. 28, 1989

[54] DOCUMENT SUSPENSION APPARATUS

[75] Inventor: Clive Selwyn-Smith, Weston on the Green, United Kingdom

[73] Assignee: Locwyn Limited, Oxon, England

[21] Appl. No.: 119,682

[22] Filed: Nov. 12, 1987

[30] Foreign Application Priority Data

Nov. 19, 1986 [GB] United Kingdom ..... 8627643
Jun. 25, 1987 [GB] United Kingdom ..... 8714914

[51] Int. Cl.[4] ..... B65D 27/00

[52] U.S. Cl. ..... 40/359; 40/617; 312/184

[58] Field of Search ..... 40/379, 401, 402, 359, 40/11 R, 617; 312/184; 211/46

[56] References Cited

U.S. PATENT DOCUMENTS

| | | | |
|---|---|---|---|
| 2,910,985 | 11/1959 | Epstein et al. | 40/359 |
| 3,238,947 | 3/1966 | Churnick | 312/184 |
| 3,724,524 | 4/1973 | Potter | 160/24 |
| 4,674,637 | 6/1987 | Lovelock et al. | 312/184 |

FOREIGN PATENT DOCUMENTS

| | | | |
|---|---|---|---|
| 1101751 | 5/1981 | Canada | 40/11 R |
| 2365353 | 2/1974 | Fed. Rep. of Germany . | |
| 2614206 | 10/1977 | Fed. Rep. of Germany . | |
| 1469636 | 1/1967 | France . | |
| 2057238 | 5/1971 | France . | |
| 2130984 | 11/1972 | France . | |
| 2358277 | 2/1978 | France . | |
| 462777 | 11/1968 | Switzerland | 40/359 |
| 569278 | 5/1945 | United Kingdom | 312/184 |
| 1100965 | 1/1968 | United Kingdom . | |
| 1116861 | 6/1968 | United Kingdom . | |
| 1116862 | 6/1968 | United Kingdom . | |
| 1189663 | 4/1970 | United Kingdom . | |
| 1223198 | 2/1971 | United Kingdom | 40/359 |
| 2008538 | 6/1979 | United Kingdom . | |
| 2013575 | 8/1979 | United Kingdom . | |
| 2122485 | 1/1984 | United Kingdom . | |
| 2145664 | 4/1985 | United Kingdom . | |

OTHER PUBLICATIONS

PCT Application, International Publication No. WO87/03542, PCT/GB86/00747, Jun. 18, 1987.

*Primary Examiner*—Robert P. Swiatek
*Assistant Examiner*—Cary E. Stone
*Attorney, Agent, or Firm*—Oliff & Berridge

[57] ABSTRACT

Suspension apparatus for supporting documents and the like, comprising a track (30) having first and second walls (31) and (32) dependent from a bridging portion (33) and defining a channel, a step (36) facing the bridging portion (33) formed within the channel on the first wall and (31) and, a suspendable article (45, 46) having a substantially lamina edge portion and an abutment. A guide member (41) extends from the second wall (32) of the track and is arranged for guiding the lamina edge portion (45) into the channel from a direction transverse to the channel and, for holding the suspendable article (45, 46) in such a way that, when the lamina edge portion (45) is engaged in the channel, the abutment may contact the step (36) and the article (45,46) may be supported by the track (30).

15 Claims, 4 Drawing Sheets

DOCUMENT SUSPENSION APPARATUS

DESCRIPTION

This invention relates to suspension apparatus for suspending articles such as documents, drawings, films, cards, envelopes, document wallets and other similar foliate articles.

An object of the invention is to provide a storage system for foliate articles which provides easy access and retrieval. In particular, apparatus in accordance with the present invention may be used for suspending documents, either alone or in document containers or pouches, in a suspension filing system of the type described in U.K. patent application No. 2145664.

Known suspension apparatus of the type to which the invention relates comprises a track having first and second walls dependent from a bridging portion and defining a channel, support means for the track, a step facing the bridging portion formed within the channel on the first wall and, a suspendable article having a substantially lamina edge portion and an abutment, the edge portion being engageable within the channel defined by the track, with the abutment in contact with the step. Examples of such suspension apparatus are described in DE-A-2365353, see FIG. 1 and related descriptive material; FR-A-2057238, see FIGS. 4 and 5 and related descriptive material and; FR-A-2358277.

In all these known arrangements, the insertion of an article, for suspension, into the channel section portion of the track, in a transverse direction to the track is hampered by a narrowness of the mouth of the track between the walls. This narrowness results from the necessary provision of means for maintaining the lamina edge portion of the suspendable article on the step, when the article is held by the track.

In accordance with the present invention suspension apparatus of the aforementioned type is provided and is characterised in that, a guide member extending from the second wall is arranged for guiding the lamina edge portion, into the channel from a direction transverse to the channel, and for holding the suspendable article with the lamina edge portion engaged in the channel and the abutment in contact with the step so that the article may be supported by the track. Thus when the abutment is above the step, a force pulling the article away from the track, in a direction transverse to the track, would cause the abutment to come into pressing engagement with the step, preventing the removal of the article from the channel in this direction.

The present invention allows the walls of the track to be spaced relatively widely apart in order to facilitate the insertion of the suspendable article into the channel, transversely to the track; while still providing means for keeping the abutment of the suspendable article on the step, once the article has been inserted into the channel. The article can only be removed from the channel by longitudinal sliding of the article with respect to the track.

Advantageously, the lamina edge portion has a thickness less than the width of the channel between the track walls and the abutment is spaced from the free edge of the lamina edge portion a distance less than that separating the step from the bridging portion and, when the lamina edge portion is located in the channel with the abutment in contact with the step, the lamina edge portion is turnable within the channel, only until its free edge contacts the second wall. Thus when the suspendable article is subjected to a force pulling it transversely away from the track, the lamina edge portion is caused to rotate until its free edge contacts the second wall, wedging the lamina edge portion between the step and the second wall. The lamina edge portion preferably is formed from a substantially rigid material.

In a preferred form of this embodiment the flange may be formed from a relatively flexible material, thereby reducing the force required to insert the lamina edge portion into the track past the flange. Optionally the track is formed from two materials; the flange being formed from a relatively flexible material and the remainder of the track being formed from a relatively hard material.

In a further embodiment the flange extends from a location on the second wall spaced further from the bridging portion than the step, into the channel section towards the first wall and the bridging portion, to a location adjacent the step. Advantageously the lamina edge portion extends from the edge of the suspendable article a smaller distance than that between the step and the bridging portion, preferably has a thickness substantially less than the distance separating the track walls and may be displaced to one side of the adjoining portion of the suspendable article. The lamina edge portion may have a thickness equal to 50% or less than the distance separating the track walls. Optionally, the step may be provided with a raised lip extending along its edge.

The suspendable article may comprise the foliate article which it is wished to suspend, with a lamina edge portion attached thereto, or a pocket or pouch arranged to hold foliate articles.

In a further aspect, the invention provides a track for use in suspension apparatus in accordance with the first aspect of the invention.

Specific embodiments of the present invention will now be described by way of example only, with reference to the following drawings.

Figure 1:
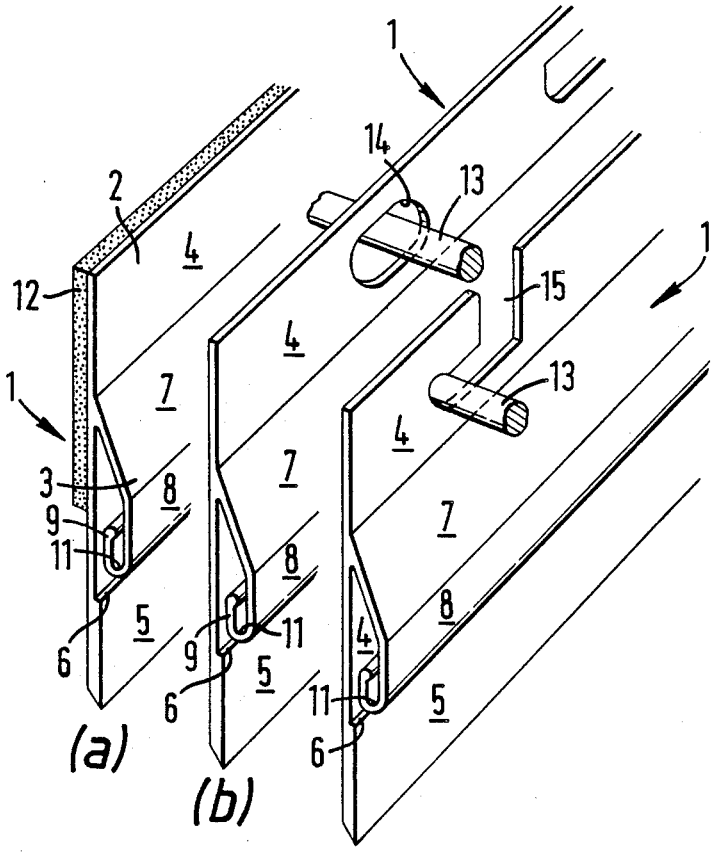
FIG. 1 illustrates three alternative embodiments of a track in accordance with the present invention, each embodiment having a different support structure.

With reference to FIG. 1, a track 1 is formed from a resiliently flexible plastics material, such as polyethylene or polyvinylchloride. The track 1 comprises a first wall 2, in the form of a substantially rectangular elongate strip and a second wall 3. As illustrated the first wall 2 has an upper thinner portion 4 and a lower thicker portion 5 defining a step 6 where the two portions 4 and 5 meet. The second wall 3 comprises an inclined portion 7 extending downwardly and away from the thinner portion 4 of the first wall 2, to a substantially upright portion 8, which is substantially parallel to the first wall 2. Extending from the upright portion 8 is an inturned portion 9, which, provides the base and one leg of a "u" sectioned channel, which is completed by the upright portion 8 to provide a first groove 11. The base of the "u" is substantially opposite the step 6 formed in the first wall 2.

A second elongate groove 10 is formed where the inclined portion 7 of the second wall 3 joins the first wall 2, on the inside of the channel formed by the walls 2 and 3.

Figure 2:
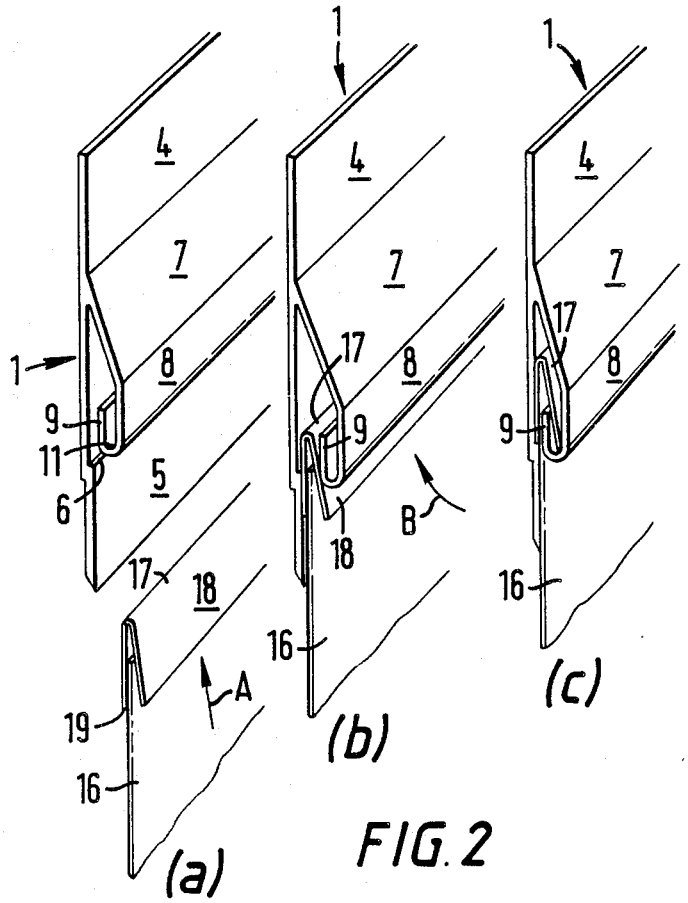
FIG. 2 illustrates the engagement of a suspendable article in a track of the type shown in FIG. 1.

The corresponding components of all the tracks 1 illustrated in FIGS. 1 and 2 have been assigned the same reference numerals as those employed above.

In FIG. 1 three alternative support means are shown. In FIG. 1(*a*) an adhesive coated sponge rubber pad 12 is shown attached to the first wall 2. In this embodiment the pad is adhered to a suitable support, such as a wall, in order to suspend the track. The remaining embodiments shown in FIG. 1 have alternative means whereby the track 1 may be suspended from a rod 13. In the embodiment depicted in FIG. 1(*b*) a substantially oval orifice 14 is formed in the portion 4 of the first wall 2, through which orifice 14 the rod 13 should extend to provide support for the track 1. In the third embodiment shown in FIG. 1(*c*) an L-shaped bight (15) is formed in the portion 4 of the first wall 2, which bight 15 is dimensioned to engage the rod 13. An advantage of the latter embodiment is that it allows the track 1 to be disengaged from the rod 13 without the need for an end of the rod 13 to be freed. For stability more than one orifice 14 or bight 15 would normally be provided in a track 1.

Figure 3:
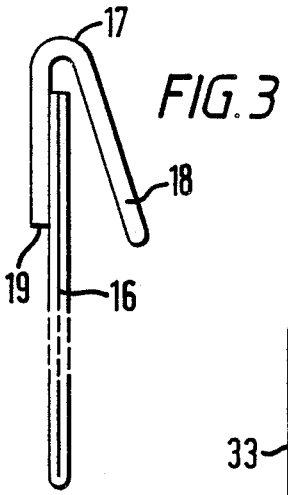
FIG. 3 is a cross-sectional detail of the article shown in FIG. 2.

An envelope 16 having a v-section rail 17 attached to its upper edge is shown in FIG. 3. The rail 17 is attached to the envelope 16 so as to provide a divergent flap 18 and a step 19. FIG. 2 illustrates the procedure for attaching the envelope shown in FIG. 3 to a track 1 of the type shown in FIG. 1. The top edge of the envelope 16 carrying the rail 17 is inserted into the gap defined between the two walls 2 and 3 of the track 1, in a direction shown by arrows A and B in FIG. 2. As the rail 17 is pushed further into track 1, from the position shown in FIG. 2(*b*) to the position shown in FIG. 2(*c*) the flap 18 is bent towards the envelope 16, narrowing the legs of the V-section rail 17, and the second wall 3 is flexed outwardly from the first wall 2. However since both the rail 17 and the track 1 are manufactured from resilient materials, once the flap 18 has passed the inturned portion 9, both the rail 17 and the second wall 3 snap back into their original form. If the envelope 16 is then allowed to hang from the track 1, the flap 18 engages in the groove 11 and the step 19 engages on the step 6. Further downward force on the envelope 16 causes the flap 18 to press the top edge of the rail 17 into contact with the first wall 2, the weight of the envelope 16 being carried by the engagement of the steps 19 and 6.

Reference will now be made to the embodiments shown in FIGS. 4, 5 and 6, which will be described as orientated in the drawings.

The track 30 comprises a first wall 31 and a second wall 32. The first wall 31 comprises upper 33, lower 34 and intermediate 35 elongate portions. The upper portion 33 and lower 34 portion are in the form of substantially rectangular co-planar strips. The intermediate portion 35 is in the form of a shallow channel with its major portion lying in a plane parallel to the upper and lower portions 33 and 34, but laterally displaced therefrom. An upwardly facing step 36 is formed at the juncture of the intermediate portion 35 and the lower portion 34. The upper surface of the step 36 is concave in cross-section. The second wall 32 comprises an inclined portion 37, extending downwardly and away from the first wall 31, to a substantially upright portion 38, which is substantially parallel to the upper and lower portions of the first wall 31. The inclined portion 37 extends from a location on the first wall 31 at the juncture of the intermediate portion 35 and upper portion 33 and, the lower portion 34 of the first wall 31 extends below the lower edge 39 of the second wall 32. The combined effect of the walls 31 and 32 is to provide a deep and elongate channel having a downwardly facing rectangular mouth 40 defined between the edge 39 and lower portion 34. The upper portion 33 carries means (not shown, but may be selected from the means illustrated in FIG. 1) for supporting the entire track 30.

A flange 41 extends inwardly and upwardly into the channel section from the upright portion 38, at a location adjacent the edge 39, towards the first wall 31. The top edge of the flange 41 is located immediately adjacent to the step 36. The flange 41 is thinner than the remaining components of the track 30 and, accordingly, when the track is formed from a material such as polyvinylchloride the flange may be resiliently flexed between its illustrated rest location and a location flat against second wall 32.

Figure 5:
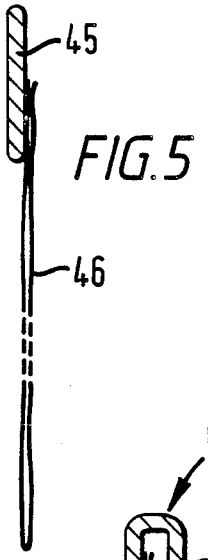
FIG. 5 is a cross-section of a second embodiment of a suspendable article.

A suspendable article, for use in conjunction with the track 30, is shown in FIG. 5. The suspendable article comprises a substantially rectangular cross-section strip 45 and a pocket 46 formed from a thin plastics material such as sheet polyethylene. The strip 45 may also be formed from polyethylene or polyvinylchloride and is of substantially greater thickness than the two parallel sheets of polyethylene making up the pocket 46. The top edge of the pocket 46 is joined to one face of the strip 45, at a location spaced a short distance from the lower edge of the strip. The lower edge of the strip is slightly convex in cross-section, having a surface which corresponds to the surface of the step 36.

Figure 4:
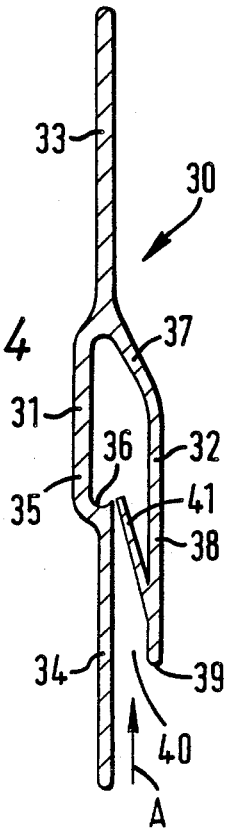
FIG. 4 is a cross-section of a second embodiment of a track in accordance with the present invention.
Figure 6:
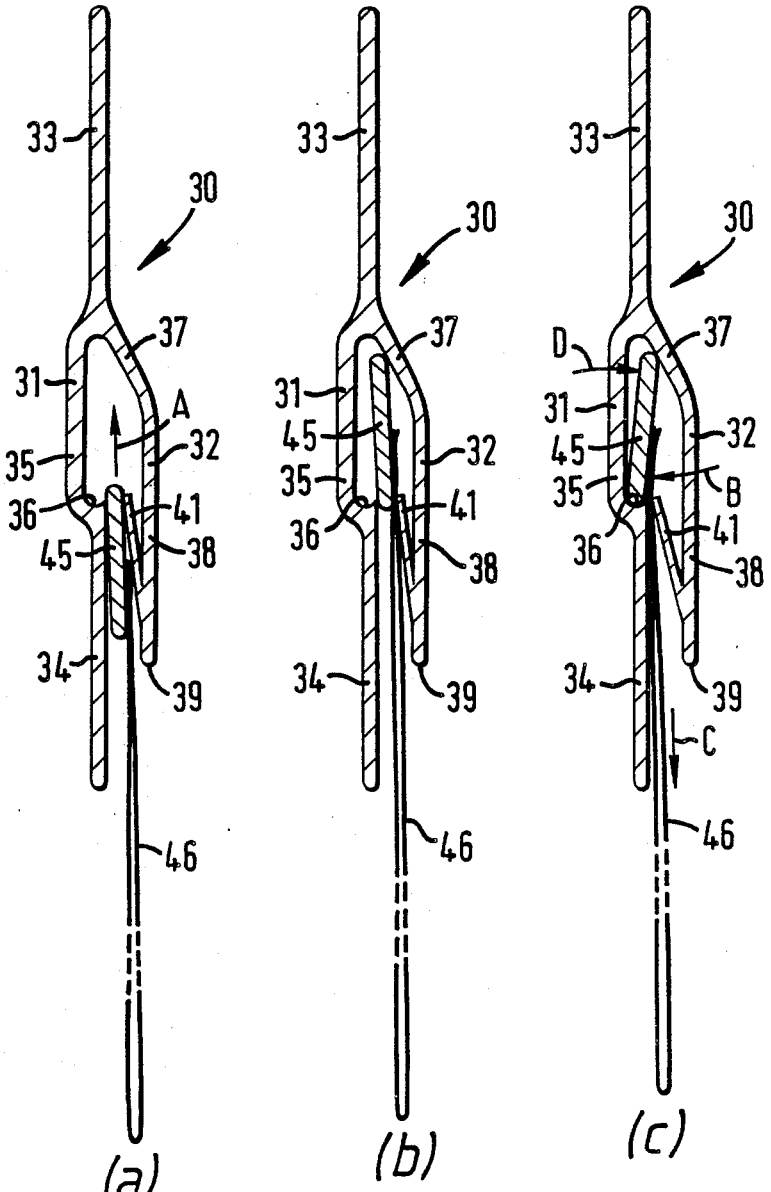
FIG. 6 shows the insertion of an article as shown in FIG. 5 into a track as shown in FIG. 4.

In use the track 30 is suspended by the upper portion 33 of the first wall 31 and the suspendable article is offered up towards the mouth 40 in a direction shown by arrow A (see FIG. 4 and 6). The strip 45 should then be pushed further into the channel defined between the walls 31 and 32, resiliently flexing the flange 41 back against the lower portion 38 of the wall 32 (see FIG. 6). Once the lower edge of the strip 45 has cleared the top edge of the flange 41 and the upper surface of the step 36, the flange 41 springs back into its rest position, in the direction of arrow B (see FIG. 6), forcing the lower edge of the strip 45 over towards and into engagement with the step 36. The weight of the pocket 46, together with any articles located therein, pulling down in the direction of arrow C causes the lower edge of the strip 45 to come into tight engagement with the step 36 and the top edge of the strip 45 to move in a direction of arrow D until its contacts the inclined portion 37 of the second wall 32. Thus the suspended article becomes locked or engaged in the track 30. The suspended article may only be removed by longitudinal sliding of the strip 45 relative to the track 30.

The suspendable article may comprise a single, substantially rigid, plastic moulding replacing the strip 45 and the pocket 46. However the essential characteristics of the suspendable article, which must be incorporated in such an alternative, are that the part of the suspended article joined to the strip must be substantially thinner than the strip itself and the strip is preferably displaced to one side of the adjacent portion of the suspended article.

Figure 7:
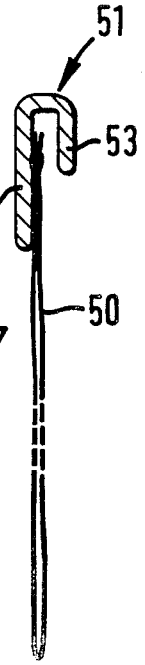
FIG. 7 is a cross-section of a third embodiment of a suspendable article.

FIG. 7 shows a further embodiment of a suspendable article which comprises a pocket 50 formed from a flexible plastics material such as polyethylene and a supporting strip 51 formed from a more rigid material such as polypropylene. The supporting strip 51 is in the form of a channel having a first wall 52 taller than a second wall 53. The pocket 50 is welded to the first wall 52 and the supporting strip 51 is formed into its channel shape by heating and folding. The susendable article so formed is held in a track 30 with the free end of the second wall 52 in engagement with the step 36.

The track 30 may be formed as an extrusion of one single material or, optionally, it can be in the form of a co-extrusion of two materials; the flange 41 being formed from a relatively flexible material and the remainder of the track 30 being formed from a relatively hard and inflexible material. Additionally the inside of the channel, defined between the walls 31 and 32 may be coated with a lubricant, for example of a silicone type, in order to facilitate the relative sliding of the track 30 and a suspended article.

I claim:

1. Suspension apparatus comprising a track having first and second walls dependent from a bridging portion and defining a channel, support means for the track, a step facing the bridging portion formed within the channel and on the first wall and, a suspendable article having a lamina edge portion defining an abutment; wherein said track further comprises a resiliently flexible guide member extending from the second wall, which guide member is arranged to guide the lamina edge portion into the channel from a direction transverse to the channel and, to co-operate with said step to positively engage said suspendable member, when said lamina edge portion thereof is within the channel and said abutment is in contact with said step, thereby supporting the suspendable article and preventing the release of the suspendable article in said transverse direction.

2. Suspension apparatus as claimed in claim 1 wherein the lamina edge portion has a thickness less than the width of the channel between the track walls and, the abutment is spaced from the free edge of the lamina edge portion a distance less than that separating the step from the bridging portion; and wherein when the lamina edge portion is located in the channel, with the abutment in contact with the step, the lamina edge portion is turnable within the channel, only until its free edge contacts the second wall.

3. Suspension apparatus as claimed in claim 2 wherein the lamina edge portion has a thickness equal to 50% or less than the distance separating the track walls.

4. Suspension apparatus as claimed in claim 2 wherein the lamina edge portion extends from the edge of the suspendable article a smaller distance than that between the step and the bridging portion, and, is displaced to one side of the adjoining portion of the suspendable article.

5. Suspension apparatus as claimed in claim 4 wherein the lamina portion comprises a substantially rectangular cross-sectioned strip.

6. Suspension apparatus as claimed in claim 2 wherein the lamina portion comprises first and second substantially rigid strip members sandwiching a substantially flexible pouch for document storage, which pouch is attached to at least one of the strip members.

7. Suspension apparatus as claimed in claim 6 wherein the first strip member is dimensioned to be engageable in the channel between the step and the bridging portion and the second strip member is substantially wider than the first strip member.

8. Suspension apparatus as claimed in claim 1 wherein the guide member comprises a flange extending from a location on the second wall spaced further from the bridging portion than the step, into the channel towards the first wall and the bridging portion, to a location adjacent to the step.

9. Suspension apparatus as claimed in claim 8 wherein the flange is substantially planar.

10. Suspension apparatus as claimed in claim 8 wherein the flange is formed from a relatively flexible material and the remainder of the track is formed from a different, relatively hard and inflexible material.

11. Suspension apparatus as claimed in claim 8 wherein the flange and the second wall have, together, a substantially "U" shaped cross-section.

12. Suspension apparatus as claimed in claim 8, wherein the step and flange extend lengthwise along a major portion of the track and the lamina edge portion and abutment extend along a major portion of an edge to the suspendable article.

13. Suspension apparatus as claimed in claim 1 wherein the step has a raised edge portion.

14. Suspension apparatus as claimed in claim 1 wherein a flap member extending from the lamina edge portion is arranged to engage in a groove formed at the junction of the guide member and the second wall, when the lamina edge portion is engaged on the step.

15. A track for use in a suspension apparatus comprising first and second walls dependent from a bridging portion and defining a channel, support means for the track, a step facing the bridging portion formed within the channel, and a flange member extending from a location on the second wall spaced further from the bridging portion than the step, into the channel towards the first wall and the bridging portion to a location adjacent to the step; wherein said flange is formed from a relatively flexible material and the remainder of the track is formed from a different, relatively hard and inflexible material.

* * * * *